United States Patent [19]

Bashinsky et al.

[11] 3,953,008

[45] Apr. 27, 1976

[54] BLAST FURNACE EVAPORATIVE COOLER

[76] Inventors: Kazimir Dominikovich Bashinsky, 521 mikroraion, 67, kv. 28; Leonid Davidovich Golod, prospekt Pravdy, 7, kv. 192; Boris Ruvimovich Granovsky, ulitsa O. Yarosha, 29, kv. 23; Leonid Markovich Dunaevsky, ulitsa Dzerzhinskogo, 95, kv. 19; Grigory Ivanovich Kasyanov, prospekt Lenina, 64b, kv. 63; Gennady Alexandrovich Kudinov, prospekt Gagarina, 32, kv. 203, all of Kharkov, U.S.S.R.

[22] Filed: May 23, 1974

[21] Appl. No.: 472,915

[30] Foreign Application Priority Data

May 25, 1973 U.S.S.R. ..... 1926807

[52] U.S. Cl. ..... 266/193

[51] Int. Cl.[2] ..... C21B 7/10

[58] Field of Search ..... 266/32, 43; 110/1 A; 122/6 B; 432/83

[56] References Cited

UNITED STATES PATENTS

| | | | |
|---|---|---|---|
| 3,379,427 | 4/1968 | Zherebin et al. | 266/32 |
| 3,704,747 | 12/1972 | Andoniev et al. | 266/32 X |

FOREIGN PATENTS OR APPLICATIONS

| | | | |
|---|---|---|---|
| 47-4765 | 2/1972 | Japan | 266/32 |

*Primary Examiner*—Gerald A. Dost
*Attorney, Agent, or Firm*—Holman & Stern

[57] ABSTRACT

An evaporative cooler for a blast furnace which is provided with a stave having a projection extending crosswise adjacent to the stave end face. The stave and the projection are provided with built-in pipes for a cooling agent to pass therethrough, with the pipe built into the projection being so arranged that its inlet and outlet end portions are interposed between the outlet end portions of the pipes incorporated in the stave. Such an arrangement of the pipes in the cooler provides for its extended service life.

2 Claims, 5 Drawing Figures

BLAST FURNACE EVAPORATIVE COOLER

BACKGROUND OF THE INVENTION

The present invention relates to apparatus for an evaporative cooling of blast furnaces used in the iron and steel industry.

The present invention may be most effective and find wide application for the cooling of the shell and brickwork of shaft-type furnaces, preferably, blast furnaces.

PRIOR TECHNIQUE

At present, evaporative cooling is widely used to cool the blast furnace shell and brickwork. Employed as a cooling agent in this application is a steam-water mixture. The cooling agent is fed through pipes built into cooling staves called coolers. These staves are rigidly attached to the furnace shell on the interior surface thereof.

Some of these staves are provided with a projection extending crosswise adjacent to the stave end face. When mounting staves, the latter are positioned with the end face directed upward and with the projection extending in the direction of the furnace interior space.

Each stave incorporates at least two main pipes for a cooling agent to pass therethrough, with the pipes being arranged lengthwise with regard to the stave.

The end portions of the pipes overhang from the stave. These pipe portions are spaced vertically at different levels. Through a lower (inlet) pipe end portion, the cooling agent is admitted into the stave, whereas via an upper (outlet) pipe end portion, the cooling agent flows out. The wider side of the stave is provided with a projection, with the inlet and outlet end portions of the pipes for circulation of the cooling agent being arranged at the stave ends, respectively, on the opposite side thereof.

PRIOR ART

Widely known is a cooler wherein one of the main pipes is used to cool the projection the pipe having a curved portion built into said projection.

However, as the projection deteriorates and the portion of the pipe located therein is burnt out, it is necessary to cease supply of the cooling agent to this pipe which results in a non-uniform cooling of the stave.

To minimize non-uniform cooling of the stave in the case of its projection failure, there has been developed a cooler fitted with a separate pipe built into the projection for the cooling thereof. The end portions of this pipe also extend beyond the stave on the side opposite to the projection. The pipe is arranged within the projection so that the longitudinal axes of its end portions are in the same plane.

However, due to the fact that the inlet and outlet ends of the pipe built into the projection are located above the outlet ends of the main pipes incorporated in the stave, when the projection deteriorates, the upper part of the stave is left without cooling. Moreover, in the pipe arranged in the projection, there are created conditions unfavorable for the cooling agent circulation since all its portions are situated at the same level.

The applicants found that high heat loads and the resulting increased steam generation inherent in the known arrangement of the cooling pipe in the stave projection hinder timely discharge of the cooling agent, thereby reducing the efficiency of cooling of the most essential top part of the stave.

Non-uniform cooling of the cooling stave gives rise to thermal stresses leading to stave damage in the projection zone in which cracking occurs. Heated gases from the blast furnace penetrate into the cracks formed thereby with the result that the thermal load on the furnace shell is increased.

In recent years, the evaporative cooling technique has gained wide acceptance since it is the most efficient method of cooling blast furnaces. An increase in the blast furnace output and internal volume as well as greater intensity of the furnace operation put forward an objective to ensure more reliable operation of the blast furnace evaporative coolers.

Moreover, a need arose to increase the number of coolers having stave projections which are used in high volume blast furnaces constructed recently.

The stave area having a projection operates under most difficult conditions since it is exposed to the effect of heated gases in the furnace, to mechanical abrasion of the burden and also takes up the pressure of the furnace brickwork.

Presently, a problem is to be solved for developing a more reliable cooling system of the cooler stave projection.

OBJECTS AND SUMMARY OF THE INVENTION

It is, therefore, the principal object of the present invention to provide an evaporative cooler for a blast furnace, which will have an extended service life as compared to known coolers of a similar type.

Another important object of the present invention is to minimize thermal stresses in the top portion of the cooler within the area in which the projection is situated.

Still another object of the present invention is to improve circulation of a cooling agent through a pipe built into the projection.

A further object of the invention is to improve cooling of the cooler top in the case of projection failure.

Yet another object of the present invention is to provide protection of the furnace shell from the effects of heated gases if the pipe built into the projection fails.

The last but not the least object of the present invention is to provide a more reliable operation of the blast furnace evaporative cooling system.

These and other objects of the invention are attained by providing an evaporative cooler comprising a stave with a projection extending crosswise adjacent to the stave end face, pipes built into said stave and projection for a cooling agent to pass therethrough, the inlet and outlet end portions of said pipes being located on the side opposite to the projection and arranged vertically at different levels, in which cooler, according to the invention, the pipe for circulation of the cooling agent in the projection is so located that its inlet and outlet end portions are arranged between the outlet end portions of the pipes incorporated in the stave.

Such arrangement of the inlet and outlet end portions of the pipe located in the projection between the outlet end portions of the pipes incorporated in the stave results in a more uniform cooling of the cooler top. In case the projection deteriorates, cooling of the stave upper part is effected by the cooling agent flowing through the outlet portions of the main pipes located in the stave. Such a design of the cooler provides for its extended service life and dependability in operation.

Preferably, the pipe for the circulation of the cooling agent in the projection has an inlet portion located in a vertical plane and an outlet portion located in a vertical plane at a higher level than the inlet portion so that the pipe portions between the inlet and outlet portions rise upwardly in the direction of flow and the pipe portions between the inlet and outlet portions being arranged at angles corresponding to 2° – 4° with respect to an imaginary horizontal line passing through the projection.

Such an inclination angle of the pipe portions provides favorable conditions for circulation of the cooling agent at the cooler top. In addition, at higher heat loads and hence increased steam generation, timely evacuation of the cooling agent is ensured thus raising the efficiency of cooling the most essential part of the stave.

The invention will be hereinafter described in more detail taking by way of example an embodiment thereof, with reference to the accompanying drawings.

BRIEF DESCRIPTION OF THE DRAWINGS

The present invention will be better understood from the detailed description of an exemplary embodiment thereof given with reference to the accompanying drawings in which.

DETAILED DESCRIPTION OF THE INVENTION

Figure 1:
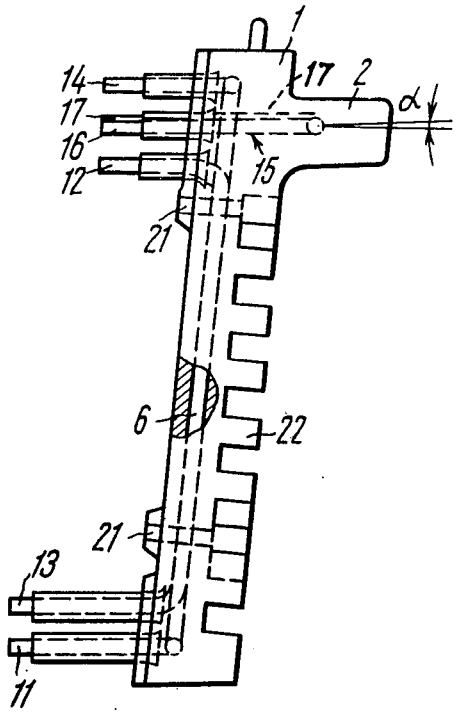
FIG. 1 is a side view partly broken away of an evaporative cooler wherein the arrangement of pipes is indicated by dash lines.

An evaporative cooler of a blast furnace comprises a stave 1 (FIG. 1) provided with a projection 2 extending crosswise relative to the stave 1 adjacent to its top. The stave 1 incorporates main pipes 3, 4, 5 and 6 for circulation of a cooling agent (a steam-water mixture) therethrough. The pipe 3 has an inlet end portion 7 and an outlet end portion 8 protruding from the stave 1 on the side opposite to that provided with the projection 2 (FIG. 1). The pipe 4 (FIG. 2) also has an inlet end portion 9 and an outlet end portion 10. The pipe 5 has an inlet end portion 11 and an outlet end portion 12. The pipe 6 has an inlet end portion 13 and an outlet end portion 14.

Figure 2:
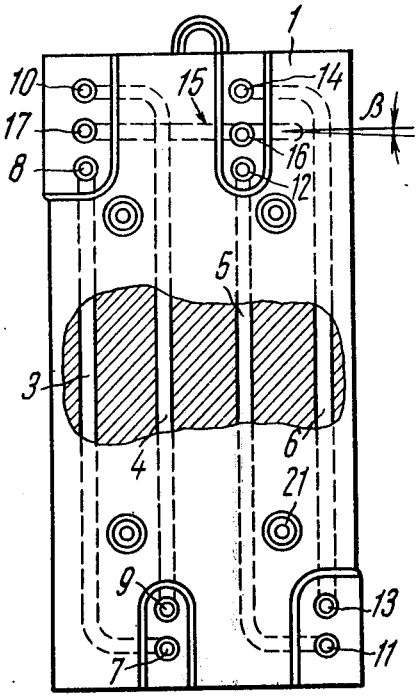
FIG. 2 is a view partly broken away of the same from the side of the inlet and outlet end portions of pipes for the circulation of a cooling agent whose arrangement is shown by dash lines.

For cooling the projection 2 (FIGS. 1 and 3), the latter is provided with a pipe 15 built thereinto and having an inlet end portion 16 and an outlet end portion 17 (FIG. 2). The inlet and outlet end portions 16 and 17 are arranged at different vertical levels with the outlet portion being at a higher level than the inlet end portion. The inlet end portion 16 (FIGS. 2 and 4) of the pipe 15 is interposed between the outlet end portion 12 of the pipe 5 and the outlet end portion 14 of the pipe 6. The outlet end portion 17 of the pipe 15 is interposed between the outlet end portion 8 of the pipe 3 and the outlet end portion 10 of the pipe 4.

The pipe 15 (FIG. 3) built into the projection 2 includes portions 18, 19 and 20 which serve to cool all of the zones of the projection and, the pipe portions extend upwardly from the inlet portion 16 to the outlet portion 17 in the direction of coolant flow. It will be noted that the portions 18, 19 and 20 are arranged at angles $\alpha$, $\beta$, and $\gamma$, corresponding to 2° – 4° with respect to a horizontal line L passing through the projection 2 as clearly depicted in FIG. 3.

Figure 3:
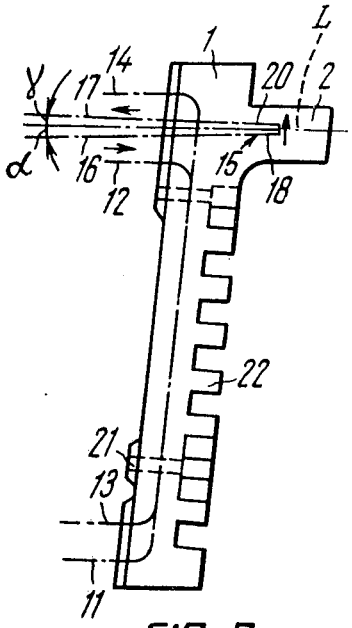
FIG. 3 shows in side view schematically an arrangement of the pipes for the cooling agent to pass through the cooler.
Figure 4:
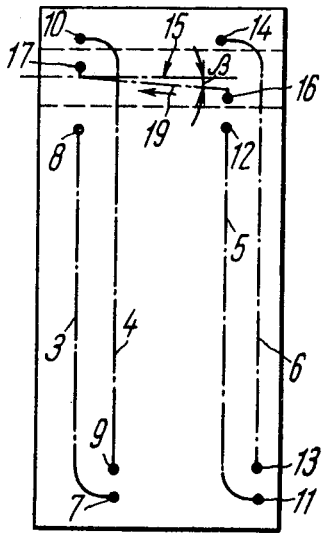
FIG. 4 illustrates schematically an arrangement of the pipes for the cooling agent to pass through the cooler, the view being on the side of the pipe inlet and outlet end portions.
Figure 5:
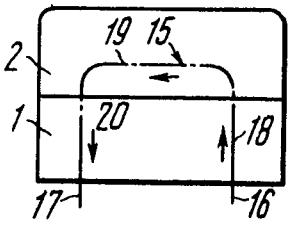
FIG. 5 is a schematic plan view of the pipe arrangement in a projection of the cooler.

FIGS. 3–5 illustrate the portion 18 of the pipe 15 located at an angle $\alpha = 2°$ (FIG. 3), the portion 19 (FIG. 5) at an angle $\beta = 3°$ (FIG. 4) and also the portion 20 (FIG. 5) at an angle $\gamma = 4°$ (FIG. 3). The angles $\alpha$, $\beta$ and $\gamma$ can be equal to each other.

The cooler is provided with through holes 21 (FIGS. 1 and 2) for receiving fastening bolts (not shown in the drawings) thereinto. The stave 1 has ribs 22 extending from the side of the projection 2 (FIG. 1).

The cooler, according to the invention, operates in the following manner:

After the erection of the coolers and the start-up of the blast furnace, all the main pipes 3, 4, 5 and 6 (FIG. 2) built into the stave 1 and the pipe 15 incorporated in the projection 2 (FIG. 3) are supplied with a cooling agent. The fact that the portions of the pipe 15 are arranged within the projection 2 at an elevation angle of 2 to 4° relative to an imaginary horizontal line passing through the projection creates favorable conditions for a circulation of the cooling agent in this pipe.

In the cooler, there is provided proper uniform cooling of its areas, especially of its end face area at which the projection 2 is located. This, in turn, provides for lower thermal stresses in the zone wherein the projection 2 is situated.

As the projection 2 and the pipe 15 built therein deteriorate, it becomes necessary to disconnect the pipe 15 from the cooling system. However, in this case, also low values of thermal stresses are maintained within the zone wherein the projection 2 is situated and sufficient cooling of the zone is provided by the main pipes 4 and 6, so no failure of the cooling stave occurs. Even in case the projection 2 fails, the blast furnace shell is protected from the effect of heated gases.

When a large number of evaporative coolers provided with projections are used, greater reliability in the operation both of the cooler top and the entire cooling system is attained.

Thus, the applicants' cooler design features an extended service life as compared with well known coolers of similar design and promotes efficient circulation of the cooling agent through the pipe 15 built into the projection 2 of the cooler.

We claim:

1. An evaporative cooler for a blast furnace comprising a stave having an end face; a projection on said stave extending crosswise adjacent to the end face thereof; pipes provided in said stave for a cooling agent to pass therethrough; inlet and outlet end portions for said pipes located on the side of said stave opposite to said projection and arranged vertically at different levels; and a pipe for circulation of a cooling agent provided in said projection and so arranged therein that its inlet and outlet end portions are interposed between said outlet end portions of the pipes incorporated within said stave.

2. The evaporative cooler for a blast furnace as claimed in claim 1 in which said pipe for circulation of a cooling agent in said projection in which the inlet and outlet end portions are located at different levels, with the outlet portion being at a higher level than the inlet end portion and said pipe including further portions between the inlet and outlet end portions, and said further portions being at an angle of 2° – 4° relative to an imaginary horizontal line passing through said projection.

* * * * *